United States Patent [19]

Hanson et al.

[11] Patent Number: 4,701,201

[45] Date of Patent: Oct. 20, 1987

[54] PROCESS TO PRODUCE COLD HELIUM GAS FOR LIQUEFACTION

[75] Inventors: Thomas C. Hanson, Buffalo; Theodore F. Fisher, Tonawanda; Joseph A. Weber, Cheektowaga; Ravindra F. Pahade, Getzville, all of N.Y.

[73] Assignee: Union Carbide Corporation, Danbury, Conn.

[21] Appl. No.: 911,226

[22] Filed: Sep. 24, 1986

[51] Int. Cl.[4] ..... F25J 3/02

[52] U.S. Cl. ..... 62/27; 62/31; 62/32; 62/36; 62/42

[58] Field of Search ..... 62/22, 23, 24, 27, 28, 62/31, 32, 36, 42

[56] References Cited

U.S. PATENT DOCUMENTS

| | | | |
|---|---|---|---|
| 2,940,271 | 6/1960 | Jackson | 62/31 |
| 3,233,418 | 2/1966 | Shaievitz | 62/38 |
| 3,347,055 | 10/1967 | Blanchard et al. | 62/9 |
| 3,373,574 | 3/1968 | Fisher | 62/20 |
| 3,389,565 | 6/1968 | Ergenc | 62/9 |
| 3,512,368 | 5/1970 | Harper | 62/21 |
| 3,599,438 | 8/1971 | Blackwell et al. | 62/22 |
| 3,609,984 | 10/1971 | Garwin | 62/22 |
| 3,643,452 | 2/1972 | Ruhemann et al. | 62/22 |
| 3,719,053 | 3/1973 | De Marco et al. | 62/22 |
| 3,740,962 | 6/1973 | Fan | 62/29 |
| 3,792,591 | 2/1974 | Collins | 62/22 |
| 3,815,376 | 6/1974 | Lofredo et al. | 62/22 |
| 3,838,553 | 10/1974 | Doherty | 62/58 |
| 4,238,211 | 12/1980 | Stuart | 62/20 |
| 4,267,701 | 5/1981 | Toscano | 62/86 |
| 4,421,537 | 12/1983 | Kuraoka | 62/22 |

OTHER PUBLICATIONS

Design & Operating Characteristics of the Sunflower Helium Plant, Crawford & Harlan; Journal of Petroleum Technology; 9/1970, pp. 1098–1102.

*Primary Examiner*—Ronald C. Capossela
*Attorney, Agent, or Firm*—Stanley Ktorides

[57] ABSTRACT

A process to produce cold helium gas suitable for use as a feed to a helium liquifier comprising employing refrigeration from a nitrogen rejection unit to reduce the temperature of the helium gas just prior to its passage to the liquifier thus enabling a reduction in the liquifier energy requirement.

10 Claims, 2 Drawing Figures

PROCESS TO PRODUCE COLD HELIUM GAS FOR LIQUEFACTION

TECHNICAL FIELD

This invention relates to the production of helium from a natural gas reservoir and is an improvement whereby helium gas can be liquified in a liquefaction unit with reduced power requirements.

BACKGROUND ART

One very important source of helium is as a component in the gas stream from a natural gas reservoir. Because of the wide difference in the volatility of natural gas, which is essentially methane, and the volatility of helium, it is relatively easy to separate helium from natural gas.

Often, however, the gas stream from a natural gas reservoir also contains a significant amount of nitrogen. The nitrogen may be naturally occurring and/or may have been injected into the reservoir as part of an enhanced gas recovery or enhanced oil recovery operation. In this situation the gas stream from the reservoir, after certain precleaning operations to remove acid gases, water, and/or higher hydrocarbons, is passed to a nitrogen reaction unit or NRU wherein the gas stream is separated into methane-richer liquid, helium-richer vapor and nitrogen-richer fluid. The nitrogen fraction may comprise from 10 to 70 percent of the feed to the NRU.

The helium-richer vapor is generally upgraded to a higher helium concentration by one or more low temperature partial liquefactions and by ambient temperature purification by pressure swing adsorption and the pure helium gas is then passed to a helium liquifier for liquefaction. Because of the extremely low boiling point of helium, the helium liquefaction requires the expenditure of a larqe amount of power.

It is therefore an object of this invention to produce helium qas from a nitrogen-containing natural gas stream which is suitable as a feed for a helium liquifier and which will enable the helium liquifier to operate with reduced power requirements.

SUMMARY OF THE INVENTION

The above and other objects which will become apparent to one skilled in the art upon a reading of this disclosure are attained by the present invention which is:

A process for the production of cold helium gas comprising (A) introducing a feed containing methane, nitrogen and helium into a nitroqen rejection unit and separating the feed within the nitrogen rejection unit into helium-richer vapor, nitrogen-richer fluid, and methane-richer liquid;

(B) withdrawing nitrogen richer fluid and helium-richer vapor from the nitrogen rejection unit, said withdrawn nitrogen-richer fluid being at a temperature within the range of from 77 to 120 K;

(C) purifying the helium richer vapor to a purity of at least 99.99 percent helium;

(D) cooling resulting helium vapor by indirect heat exchange with warming nitrogen-richer fluid to produce cold helium gas; and (E) passing cold helium gas to a helium liquifier for liquefaction into liquid helium.

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbook, Fifth Edition, edited by R. H. Perry and C. H. Chilton, McGraw Hill Book Company, New York Section 13, "Distillation" B. D. Smith et al., page 13-3, *The Continuous Distillation Process.*

The term "double column", is used herein to mean a high pressure column having its upper end in heat exchange relation with the lower end of a low pressure column. An expanded discussion of double columns appears in Ruheman, "The Separation of Gases" Oxford University Press, 1949, Chapter VII, Commercial Air Separation, and Barron, "Cryogenic Systems", McGraw Hill, Inc., 1966, p. 230, Air Separation Systems.

The term "indirect heat exchange" is used herein to mean the bringing of two fluid streams into heat exchange relation without any physical contact or intermixing of the fluids with each other.

The terms "nitrogen rejection unit" and "NRU" are used herein to mean a facility wherein nitrogen and methane are separated by cryogenic rectification, comprising either a single or a double column along with the attendant interconnecting equipment such as liquid pumps, phase separators, piping, valves and heat exchangers.

DETAILED DESCRIPTION

The invention will first be described in detail with reference to FIG. 1 which illustrates the use of a double column NRU.

Figure 1:
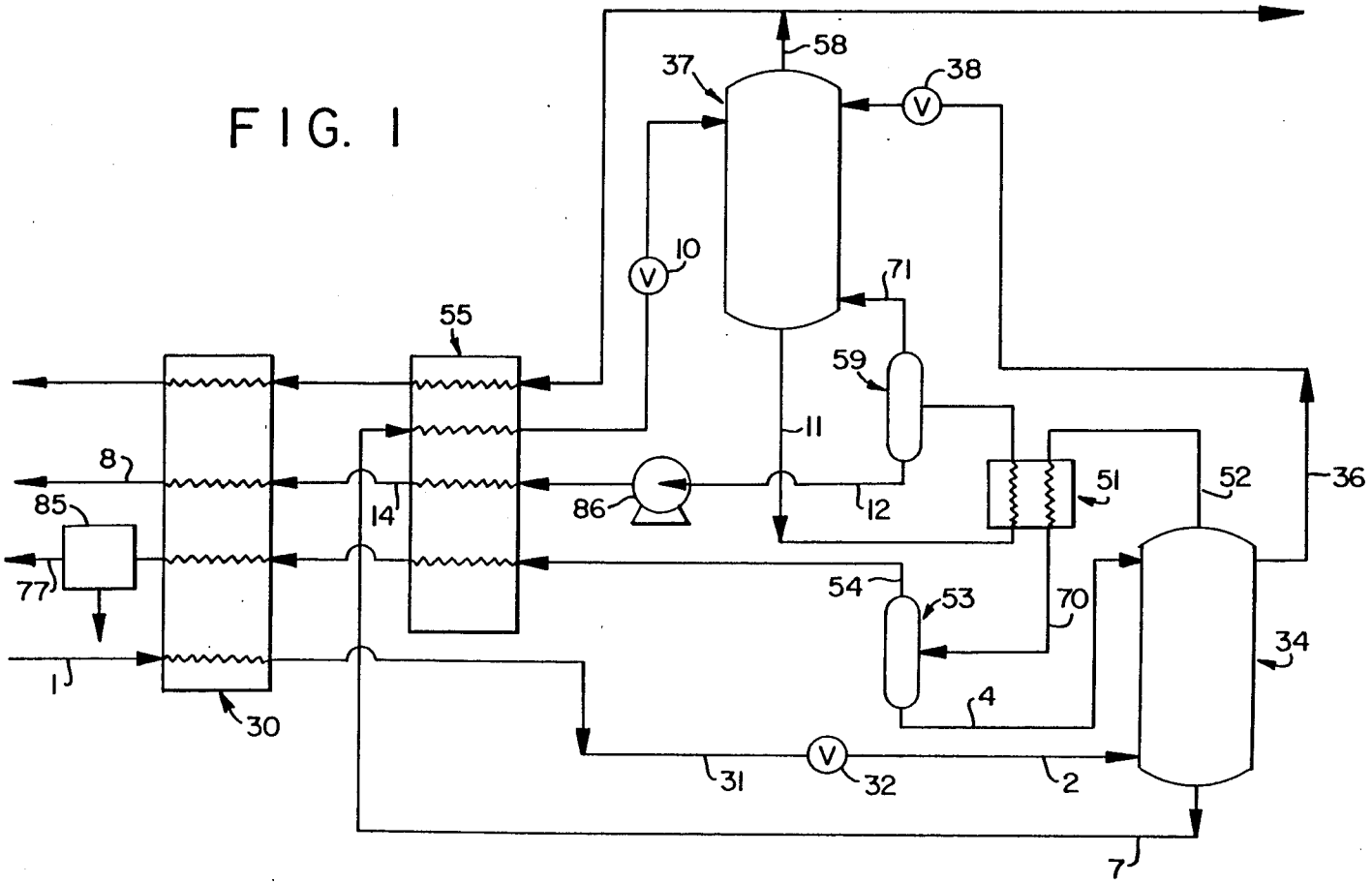
FIG. 1 is a simplified schematic flow diagram of a double column nitrogen rejection unit.

Referring now to FIG. 1, gaseous feed stream 1, such as from a natural gas reservoir, which comprises nitrogen, methane and helium and is generally at a pressure exceeding about 500 psia, is cooled by passage through heat exchanger 30 to produce cooled gaseous feed 31. Gaseous feed taken from a natural gas reservoir may have been previously processed to remove water, acid gases and/or higher hydrocarbons. The gaseous feed may contain several percent helium and generally contains from 0.5 to 3 percent helium. Cooled gaseous feed 31 is expanded, such as by passage through valve 32, to partially liquefy the feed, and the two-phase feed 2 is introduced into column 34.

Column 34 may be a single column, or as is illustrated in FIG. 1, may be the higher pressure column of a double column arrangement. The choice of using either a double column or a single column NRU is an engineering decision which can be made by anyone skilled in this art. Generally a double column NRU is preferred when the feed comprises 25 percent or more of nitrogen, and a single column NRU is preferred when the feed contains less than 25 percent nitrogen. The principles of operation of single and double column cryogenic rectification plants are well known to those skilled in the art and no further detailed description is necessary here.

Column 34 is operating at a pressure within the range of from 250 to 450 psia, preferably within the range of from 300 to 400 psia. Within column 34 the feed is separated into a methane liquid, i.e., a liquid having a methane concentration which exceeds that of the feed, and into a nitrogen helium vapor which has a nitrogen helium concentration which exceeds that of the feed.

Most of the nitrogen helium vapor is condensed and the resulting liquid is employed as liquid reflux for the column. In the double column embodiment illustrated in FIG. 1, the nitrogen-helium vapor 52 is partially condensed against boiling lower pressure column bottoms in heat exchanger 51 and the resulting two phase stream 70 is passed to phase separator 53 and separated into crude helium vapor 54 and nitrogen-rich liquid 4 which is returned to column 34 and passed down through column 34 as reflux. In addition, a portion of the resulting liquid is withdrawn through line 36, expanded through valve 38 and passed into lower pressure column 37 as liquid reflux. The lower pressure column operates at a pressure within the range of from 12 to 40 psia, preferably within the range of from 20 to 30 psia.

Helium vapor 54 will generally have a helium concentration of at least 30%. It can be rewarmed using incoming process streams as shown in FIG. 1, or it can be further upgraded prior to the rewarming step. The cold temperature upgrading is generally done by one or more serial partial liquefactions with the vapor from the previous liquefaction becoming feed to the next partial liquefaction. The upgraded cold crude helium, with a helium concentration of at least about 80% is then rewarmed. Either the rewarmed vapor 54 or the further upgraded vapor is then further purified at ambient temperature. The warm temperature purification is typically performed by a pressure swing adsorption unit 85 and produces liquefier grade helium gas 77. That helium gas has a very high purity of at least 99.99% helium and usually contains less than 10 ppm impurity levels. The high purity helium stream is then passed to a heat exchange step which will be described later in conjunction with FIG. 2.

Referring back now to FIG. 1, methane-richer liquid is withdrawn from column 34 as stream 7, cooled by indirect heat exchange in heat exchanger 55 against return streams, expanded through valve 10, and introduced as feed into lower pressure column 37.

Within lower pressure column 37 the feed is separated by cryogenic rectification into nitrogen-rich vapor and methane rich liquid. The nitrogen-rich vapor is withdrawn from column 37 as stream 58 and some of this stream is passed to the heat exchange step which will be described with reference to FIG. 2. The majority of stream 58 is rewarmed against incoming streams in heat exchangers 55 and 3 and may be recovered for further use or released to the atmosphere.

Figure 2:
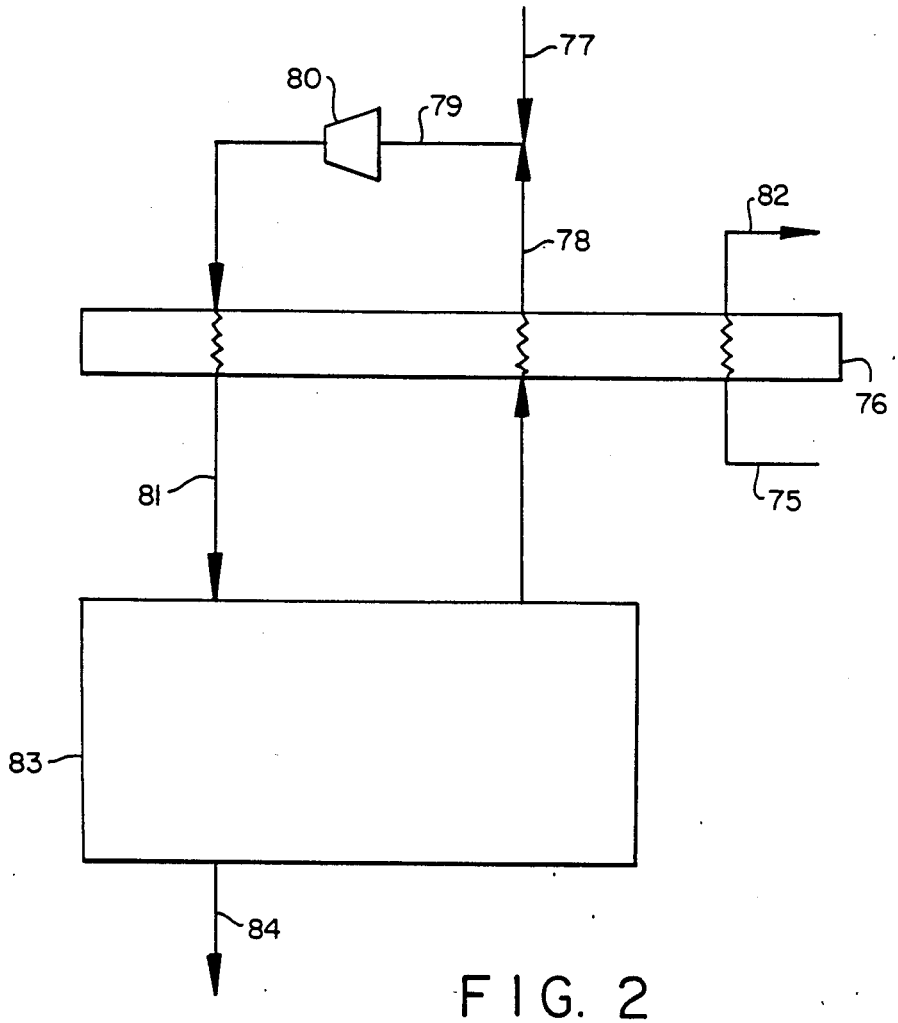
FIG. 2 is a schematic flow diagram of the heat exchange between nitrogen-richer fluid and helium vapor.

It should be noted that the nitrogen-richer heat exchange fluid referred to with reference to FIG. 2 can be in the liquid form. Thus a portion of stream 36 could be utilized for that heat exchange step. The liquid could be at high pressure as obtained from column 34 or after pressure reduction as for column 37.

Methane-rich liquid is withdrawn from column 37 as stream 11, partially vaporized against higher pressure column top vapor in heat exchanger 51, and passed to phase separator 59 for separation into vapor 71 which is returned to column 37 and liquid 12. Liquid 12 is pumped by pump 86 and then heated by indirect heat exchange in heat exchanger 55 to produce warm methane-rich liquid stream 14 which is then vaporized by indirect heat exchange through heat exchanger 30 against cooling gaseous feed to produce methane gas 8 which may be recovered directly or compressed to a higher pressure prior to recovery.

Referring now to FIG. 2 nitrogen-richer fluid 75 is passed to heat exchanger 76. Fluid 75 may be either vapor or liquid and is at a temperature at most about 120 K and preferably at a temperature within the range of from 77 to 100 K. Stream 75 is taken from the nitrogen rejection unit. For example stream 75 could be part of stream 58 of FIG. 1. Stream 75 generally has a nitrogen concentration within the range of from 90 to 99 percent.

Helium vapor stream 77 has a helium concentration generally at least 99.99 percent. This stream is ultimately also from the NRU such as being all or part of stream 54 of FIG. 1. As described, the NRU source stream 54 for stream 77 undergoes upgrading such as by partial liquefaction and pressure swing adsorption to increase the helium concentration.

Stream 77 is conveniently combined with return stream 78 and the combined stream 79 is compressed in compressor 80, cooled against cooling water (not shown), and then cooled by passage through heat exchanger 76 to produce cold helium gas 81. The return stream portion 78 of stream 79 essentially cools against itself while the helium-richer stream 77 of stream 79 cools against warming nitrogen-richer fluid 75. When the nitrogen-richer fluid 75 is a gas, its flowrate is within the range of from about 75 to 125 percent of, and preferably about equal to, the flowrate of stream 77. When the nitrogen richer fluid 75 is a liquid, its flowrate is within the range of from about 25 to 75 percent of, and preferably about one-half of, the flowrate of stream 77. Warmed nitrogen stream 82 which emerges from the indirect heat exchange in heat exchanger 76 may then be recovered in whole or in part, returned to the NRU for further processing, or simply released.

Cold helium gas 81 is then passed to helium liquifier 83 wherein it is liquified to produce liquid helium 84. Because of the heat exchange within heat exchanger 76 the cold helium gas 81 is delivered to the liquifier 83 in a significantly colder condition thus enabling the liquifier to operate with markedly reduced energy requirements. The refrigeration to accomplish this cooling is not provided by an external source such as stored on-site liquid nitrogen, but rather is supplied directly from the NRU which serves also to initially produce the helium from the gas reservoir feed stream. The invention comprises the recognition that where one has a gas reservoir stream comprising methane, nitrogen and helium which is passed to an NRU for methane recovery, the NRU will possess significant excess refrigeration and this excess refrigeration, in the form of withdrawn cold nitrogen, may be gainfully employed to reduce the power requirements of a helium liquifier, without upsetting the requisite heat transfer driving forces within the NRU process.

The following tabulation in Table I represents the results of a computer simulation of the process of this invention carried out with a double column NRU. The stream numbers in Table I correspond to those of FIGS. 1 and 2.

TABLE I

| Stream No. | 1 | 2 | 54 | 58 | 75 | 77 | 82 |
|---|---|---|---|---|---|---|---|
| Flow, lb mole/hr | 1000 | 1000 | 42.0 | 369 | 10.7 | 15.0 | 10.7 |
| Temperature, K | 260.9 | 142.9 | 110.1 | 85.9 | 86 | 270 | 265 |
| Pressure, psia | 1005 | 400 | 400 | 35 | 35 | 20 | 30 |
| Composition, mole % | | | | | | | |
| Helium | 1.7 | 1.7 | 37.2 | 0.4 | 0.4 | 99.999 | 0.4 |
| Nitrogen | 41.1 | 41.1 | 62.7 | 99.4 | 99.4 | — | 99.4 |
| Methane | 57.2 | 57.2 | 0.1 | 0.2 | 0.2 | — | 0.2 |

Now, by the process of this invention, one can effectively employ refrigeration from an NRU to reduce the temperature of helium gas prior to its passage to a helium liquifier, thus enabling the helium liquifier to operate with reduced energy requirements.

Although the process of this invention has been described in detail with reference to a certain specific embodiment, those skilled in the art will recognize that there are other embodiments of this invention within the spirit and scope of the claims.

We claim:

1. A process for the production of cold helium gas comprising (A) introducing a feed containing methane, nitrogen and helium into a nitrogen rejection unit and separating the feed within the nitrogen rejection unit into helium richer vapor, nitrogen-richer fluid, and methane-richer liquid;

(B) withdrawing nitrogen richer fluid and helium-richer vapor from the nitrogen rejection unit, said withdrawn nitrogen-richer fluid being at a temperature within the range of from 77 to 120 K;

(C) purifying the helium-richer vapor to a purity of at least 99.99 percent helium;

(D) cooling resulting helium vapor by indirect heat exchange with warming nitrogen-richer fluid to produce cold helium gas; and (E) passing cold helium gas to a helium liquifier for liquefaction into liquid helium.

2. The process of claim 1 wherein the feed comprises from 0.5 to 3 percent helium.

3. The process of claim 1 wherein the nitrogen rejection unit comprises a single column cryogenic nitrogen rejection unit.

4. The process of claim 1 wherein the nitrogen rejection units comprises a double column cryogenic nitrogen rejection unit.

5. The process of claim 1 wherein the purification of step (C) is carried out by pressure swing adsorption.

6. The process of claim 5 wherein the pressure swing adsoption is preceded by at least one partial liquefaction of the helium richer vapor.

7. The process of claim 1 wherein the warming nitrogen-richer fluid is a vapor and has a flowrate within the range of from 75 to 125 percent of the cooling helium vapor flowrate.

8. The process of claim 1 wherein the warming nitrogen-richer fluid is a liquid and has a flowrate within the range of from 25 to 75 percent of the cooling helium vapor flowrate.

9. The process of claim 1 wherein the warming nitrogen-richer fluid has a nitrogen concentration within the range of from 90 to 99 percent.

10. The process of claim 1 wherein the helium vapor is compressed prior to the cooling in step (D).

* * * * *

UNITED STATES PATENT AND TRADEMARK OFFICE

CERTIFICATE OF CORRECTION

PATENT NO. : 4,701,201

DATED : October 20, 1987

INVENTOR(S) : T.C. Hanson et al

It is certified that error appears in the above-identified patent and that said Letters Patent is hereby corrected as shown below:

In column 1, line 54 delete "nitroqen" and insert therefor --nitrogen--.

In column 3, line 63 delete "for" and insert therefor --from--.

Signed and Sealed this

Twenty-third Day of February, 1988

*Attest:*

DONALD J. QUIGG

*Attesting Officer*

*Commissioner of Patents and Trademarks*